US005534234A

United States Patent [19]

Reddin et al.

[11] Patent Number: 5,534,234

[45] Date of Patent: Jul. 9, 1996

[54] RECOVERY OF MANGANESE FROM LEACH SOLUTIONS

[76] Inventors: Lorin D. Reddin, 1437 E. 3115 South, Salt Lake City, Utah 84016; Malcolm T. Hepworth, 6908 Cornelia Dr., Edina, Minn. 55435; Rachid Ben-Slimane, 1016 17th Ave. SE., Minneapolis, Minn. 55414; Glenn D. Welch, 6390 Golden Chain Rd., Murray, Utah 84107

[21] Appl. No.: 339,083

[22] Filed: Nov. 14, 1994

[51] Int. Cl.[6] ..... C01G 45/00; C22B 47/00

[52] U.S. Cl. ..... 423/50; 423/49; 423/144; 423/DIG. 4

[58] Field of Search ..... 423/49, 50, 144, 423/DIG. 4

[56] References Cited

U.S. PATENT DOCUMENTS

| | | | |
|---|---|---|---|
| 2,927,063 | 3/1960 | Batchelor et al. | 202/31 |
| 3,869,360 | 3/1975 | Kane et al. | 423/DIG. 4 |
| 3,906,075 | 9/1975 | Menz | 423/DIG. 4 |
| 3,923,615 | 12/1975 | Kane et al. | 423/DIG. 4 |
| 4,061,716 | 12/1977 | McGauley | 423/244 |
| 4,138,465 | 2/1979 | Pahlman et al. | 423/49 |
| 4,164,544 | 8/1979 | Olsson et al. | 423/230 |
| 4,298,580 | 11/1981 | Harper et al. | 423/140 |
| 4,732,888 | 3/1988 | Jha et al. | 502/406 |

FOREIGN PATENT DOCUMENTS

| | | | |
|---|---|---|---|
| 658453 | 2/1963 | Canada | 423/230 |
| 3-186317 | 8/1991 | Japan | 423/230 |
| 6-63393 | 3/1994 | Japan | 502/407 |
| 350850 | 9/1972 | U.S.S.R. | 423/49 |

OTHER PUBLICATIONS

*CRC Handbook of Chemistry and Physics,* 67th Edition, CRC Press, Inc., Boca Raton, FL, pp. B–105 and B–144 (1986–1987), no month.

S. Z. El Tawil et al., "High–Grade Manganese Dioxide from Low–Grade Ores", *JOM,* 38–39 (May, 1989).

G. D. Focht et al., "High–Temperature Desulfurization Using Zinc Ferrite: Reduction and Sulfidation Kinetics," *Chemical Engineering Science, 43,* 3005–3013 (1988), no month.

M. T. Hepworth et al., "Thermodynamic Comparison of Lime as a Desulfurizer with Iron in Coal Combustion Atmostpheres: Fe–FeO–Liquid Equilibrium", *Energy & Fuels,* 5, 237–243 (1991), no month.

M. T. Hepworth et al., "Thermodynamic Comparison of Several Sorbent Systems for Hot Coal–Derived Fuel–Gas Desulfurization", *Energy & Fuels, 7,* 602–609 (Sep./Oct. 1993).

I. Iwasaki et al., "Leaching and Recover of Manganese from Magnetic Separator Tailings of Manganiferous Iron Ores Reduced by the R–N Process", *Society of Mining Engineers of AIME,* pp. 1–41, presented at the American Institute of Mining, Metallurgical and Petroleum Engineers, Los Angeles, CA, Feb. 19–23, 1967.

Y. Kono et al., "A Precipitation Separation Method for Cu, Ni and and Co Recovery from Sulfurous acid Leach Liquor of Sea Manganese Nodule", *J. Min. Metall. Inst. Jpn., 102, 585–590 (Sep., 1986)—English Language abstract included on last page.*

K. C. Nathsarma et al., "Separation of Iron and Manganese from Suplphate Solutions Obtained from Indian Ocean Nodules", *Hydrometallurgy, 17,* 239–249 (1987), no month.

K. C. Nathsarma et al., "Precipitation of iron and manganese from ammoniacal–ammonium sulphate solutions obtained from Indian Ocean manganese nodules", *Erzmetall, 42,* 259–262 (1989), no month.

(List continued on next page.)

*Primary Examiner*—Steven Bos

*Attorney, Agent, or Firm*—Mueting, Raasch, Gebhardt & Schwappach

[57] ABSTRACT

Methods of recovering manganese in the form of manganese carbonate from ores containing manganese and iron while also removing substantially all of the iron contained in the sulfurous acid leach solution are disclosed.

15 Claims, 4 Drawing Sheets

OTHER PUBLICATIONS

J. E. Notestein, *Commercial Gasifier for IGCC Applications Study Report,* U.S., Department of Energy, Office of Fossil Energy, Morgantown Energy Technology Center, pp. 13–33 (Jun., 1990).

E. T. Turkdogan et al., "Desulfurization of Hot Reducing Gases with Manganese Oxide Pellets", *Proceedings of the Third International Iron and Steel Congress ASM:* ASM International: Chicago, IL; 277–288 (Apr., 1978).

E. T. Turkdogan, *Physical Chemistry of High Temperature Technology;* Academic Press: New York:4–26 (1980) no month.

P. r. Westmoreland et al., "Evaluation of Candidate Solids for High–Temperature Desulfurization for Low–Btu Gases", *Environ. Sci. Technol.,* 10, 659–661 (Jul., 1976).

P. R. Westmoreland et al., "Comparative Kinetics of High–Temperature Reaction Between $H_2O$ and Selected Metal Oxides", *Environ. Sci. Technol., 11,* 488–491 (May, 1977).

M. C. Woods et al., "Reaction between $H_2O$ and Zinc Oxide–Titanium Oxide Sorbents. 1. Single–Pellet Kinetic Studies", *I&EC Research, 29,* 1150–1167 (1990), no month.

RECOVERY OF MANGANESE FROM LEACH SOLUTIONS

STATEMENT OF U.S. GOVERNMENT RIGHTS

The U.S. government has rights to this invention. This invention was made with U.S. Government grant support under the U.S. Bureau of Mines, U.S. Department of the Interior, Contract #299002.

FIELD OF THE INVENTION

The present invention relates to the field of solution treatment for the recovery of manganese. More particularly, the present invention relates to methods of recovering manganese from an aqueous liquor derived from heap, vat or in situ leaching.

BACKGROUND OF THE INVENTION

Processes of leaching mineral bearing ores to recover valuable products are known. Typically, a lixiviant solution is introduced to the ore and the resulting liquid, i.e., leach liquor, is then processed to remove the desired products. Manganese bearing ores are particularly amenable to leaching as a method to remove the manganese contained in the ores.

Manganese, in form of manganese carbonate, is an important raw material component in the manufacture of regenerable sorbent pellets for the removal of hydrogen sulfide from hot coal-derived fuel gases. Manganese carbonate can also be easily integrated as a feed material to existing electrolytic manganese and electrolytic manganese dioxide plants.

A number of studies on the manganese-sulfur-oxygen (Mn—S—O) system have indicated that a Mn-based sorbent pellet has considerable potential application in the desulfurization of coal-derived fuel gases at high temperature. A $MnCO_3$ based sorbent pellet offers a highly desirable combination of reaction kinetics and sulfur loading capacity.

When forming sorbent pellets for the desulfurization of gases, it is particularly important that the manganese carbonate be as pure as possible and that impurities, such as iron, be minimized to provide pellets which capture high amounts of sulfur and can be regenerated for reuse over a number of cycles. Under reducing conditions, the iron-oxygen-sulfur (Fe—S—O) system forms a series of low melting-point liquid solutions which inhibit sorbent pellet reactivity with sulfur. Iron removal is, therefore, important for maximizing the desulfurization potential of manganese-based sorbent pellets.

Although reductive acid leading is a known method of obtaining manganese from ores, one problem with acid leaching processes is, however, the leaching of impurities along with the manganese. If the ore contains iron, which it typically does, the leaching process also removes a significant amount of iron in addition to manganese, thereby complicating processing of the leach liquor to selectively remove the manganese without significant quantifies of iron.

Products containing manganese and iron may be useful if used as a steel additive, but that use does not economically justify the processing necessary to extract the manganese and iron together. For these reasons, treatment of acid leach solutions should be focused on producing manganese in the form of carbonate which is substantially free of base metal impurities such as iron.

Several procedures separating nickel, copper, cobalt and iron from deep sea nodules in chloride-based and sulfate-based systems have been developed. Many of those processes, however, are not focused on the recovery of manganese.

One process for extracting manganese from deep sea nodules using a hydrochloric acid-based leach liquor has been developed by Metallurgie Hoboken-Overpelt. After solubilization of the nodules in strong hydrochloric acid which produces manganous chloride, chlorine is used to oxidize the manganous chloride under conditions of controlled pH by additions of magnesia to precipitate manganese as a dioxide. The leach solutions were first purified of iron, zinc, copper, aluminum, nickel, and cobalt by a series of prior selective precipitation steps which include adding sulfuric acid followed by sulfide precipitation. This process depends upon the initial presence of manganese in the dioxide form to generate chlorine in the leaching reactors.

Another process for recovering manganese from leach liquors produced by sulfuric acid leaching of manganiferous iron ores is known. The starting solutions had a reduction potential of −310 mV vs. saturated calomel. The more rapid oxidation kinetics of iron over that of manganese were used by aerating the solution at a controlled pH to precipitate iron selectively and purify the manganese solution. At a pH of 7.25 and an aeration time of 15 min, a solution initially containing 28 g/l Mn and 3.8 g/l Fe was separated into a treated liquor containing 28 g/l Mn and less than 0.1 g/l Fe. After 45 minutes of aeration, some loss of manganese to the precipitated iron occurred.

In one series of tests, recovery of manganese was by electrowinning at the cathode; however, and in separate tests, recovery of manganese was by electro-oxidation and deposition of manganese dioxide at the anode of an electrolytic cell. In any event, the amounts of iron remaining in the treated liquors which contained substantially all of the initial manganese, i.e., 0.1 g/l of Fe, was too high for processing into manganese based sorbent pellets for the desulfurization of coal-derived fuel gases.

In another process manganese was extracted from low grade ores by calcining in the presence of ammonium sulfate followed by water-leaching to produce a solution of a relatively low iron content and a high manganese content by careful control of the calcination conditions. The resulting solutions were then oxidized by contacting them with fresh ore containing manganese dioxide to convert the iron to the ferric state. Iron was then selectively precipitated at a pH of 6.5 by ammonia addition. Finally, manganese was recovered at a pH of 8.5 by precipitation as manganese carbonate. After treating the manganese carbonate with nitric acid and baking at 200° C. To remove the nitrates, a pure manganese dioxide product resulted.

A combination process for the recovery of both metallic iron and metallic manganese from manganiferous iron ores of the Cuyuna range has also been developed. In the process, iron is recovered by direct reduction and magnetic separation, and the manganese is recovered from the nonmagnetic tailing by leaching and electrolysis. The initial electrolytic solutions typically contained about 28 g/l manganese with the depleted solutions containing 17 to 18 g/l for only a 35% drop in solution concentration. The disadvantages of this process include current efficiencies of only 60 percent and the requirement for a significant recycle stream of lixiviant, both of which increase the cost of obtaining the manganese present in the ore.

Yet another process for recovering manganese involves a precipitation separation method to separate copper, nickel, cobalt and manganese from sulfurous acid leach liquors resulting from leaching of deep sea nodules. A slight excess of sulfurous acid is used in the leach process to reduce all the manganese to the divalent state. Iron is then oxidized under ambient conditions by aeration and addition of $Na_2CO_3$. The iron is then precipitated as ferric hydroxide by adjustment of the pH of the leach liquor to values in the range of 4.0 to 4.9. Subsequently, manganese is precipitated as $MnCO_3$ by the addition of ammonium carbonate which raises the pH value to 9–10. The copper, nickel, and cobalt remained in solution since they had been stabilized as amine-complexes. After several trials, over 90% recoveries of copper, nickel, and cobalt were obtained and about 97% of the manganese and 99.9% of the iron were removed.

One disadvantage of this process includes the use of ammonia which is expensive and difficult to recycle for further use, thereby eliminating the ability to reduce costs by reusing the ammonia and adding to the costs of disposal.

SUMMARY OF THE INVENTION

The present invention provides methods of recovering manganese from ores containing manganese and iron in the form of manganese carbonate while also removing substantially all of the iron contained in the leach solution.

One important feature of the methods according to the present invention is their reliance on kinetic factors to selectively precipitate iron while substantially maintaining the manganese in solution for later removal. As described in more detail below, review of known thermodynamic data concerning leach liquor solutions containing manganese and iron in levels associated with the methods of the present invention, selective precipitation of the iron would not be possible under equilibrium conditions.

In one aspect, the method according to the invention involves the leaching of ore containing manganese and iron with sulfurous acid to produce a leach liquor having about 25–35 g/l Mn and up to about 3 g/l Fe. The leach liquor is oxidized with a suitable oxidizing agent to oxidize the ferrous iron which is then precipitated out in the form of ferric hydroxide with the addition of milk of lime in a kinetic reaction.

The present invention also provides for the precipitation of manganese from the process stream, after precipitation of the iron preferably using sodium carbonate.

Advantages of the methods according to the present invention include the economic recovery of manganese carbonate in a product which is substantially iron-free and suitable for further processing to form sorbent pellets for the desulfurization of coal-derived fuel gases.

These and other features and advantages of the present invention will be apparent upon review of the detailed description below.

DETAILED DESCRIPTION OF THE PREFERRED METHODS

The preferred process for leaching manganese bearing ores according to the present invention involves the use of sulfurous acid solutions. The sulfurous acid lixiviant is relatively selective toward the manganese mineralization, producing a leach liquor in which iron is the only significant contaminant. Typical composition of the leach liquor is given in Table 1. Liquors of this composition can be produced by heap, vat, and in sire leaching methods, any of which can be applied to both domestic and imported ores.

TABLE 1

Typical Leach Liquor Composition

| Mn (g/l) | Fe (g/L) | K (ppm) | Al (ppm) | Ca (ppm) | $S_2O_6$ (g/L) |
|---|---|---|---|---|---|
| 28.0 | 2.1 | 670 | 358 | 350 | 55 |
| Si (ppm) | Na (ppm) | Mg (ppm) | Ba (ppm) | $SO_4$ (g/L) | $SO_2$ (g/L) |
| 85.0 | 100 | 90 | 4 | 28 | 3–7 |

Although the chemical composition of the typical leach liquor is amenable to removal of the manganese along with the dominant minor element, Fe, in an equilibrium-based removal process, the product of that processing cannot be used to form manganese-based sorbent pellets for desulfurizing coal-derived fuel gases because of the high levels of iron.

One preferred leaching process is conducted in situ, i.e., through the introduction of sulfurous acid into manganese-beating ore formations and allowing the lixiviant to migrate through the ore, leaching the minerals. The liquor can then be pumped to the processing equipment preferably located nearby for processing.

Alternatively, it will be understood that the process of selectively precipitating the iron, followed by precipitation of the manganese as manganese carbonate can be performed with liquors produced by vat or heap leaching processes using sulfurous acid to extract manganese from mined manganese bearing ore.

As discussed above, the difficulty with processing the leach solution formed by sulfurous acid leaching is the selective removal of iron and manganese carbonate in such a manner as to minimize iron contamination of the manganese carbonate precipitate.

Review of the Eh-pH diagrams for the hydrated iron and hydrated manganese systems based on known thermodynamic data (see FIG. 1 ) shows the equilibria at 25° C. between iron in the zero, +2 and +3 oxidation states and the hydrated species $Fe(OH)_2$ and $Fe(OH)_3$.

Figure 1:
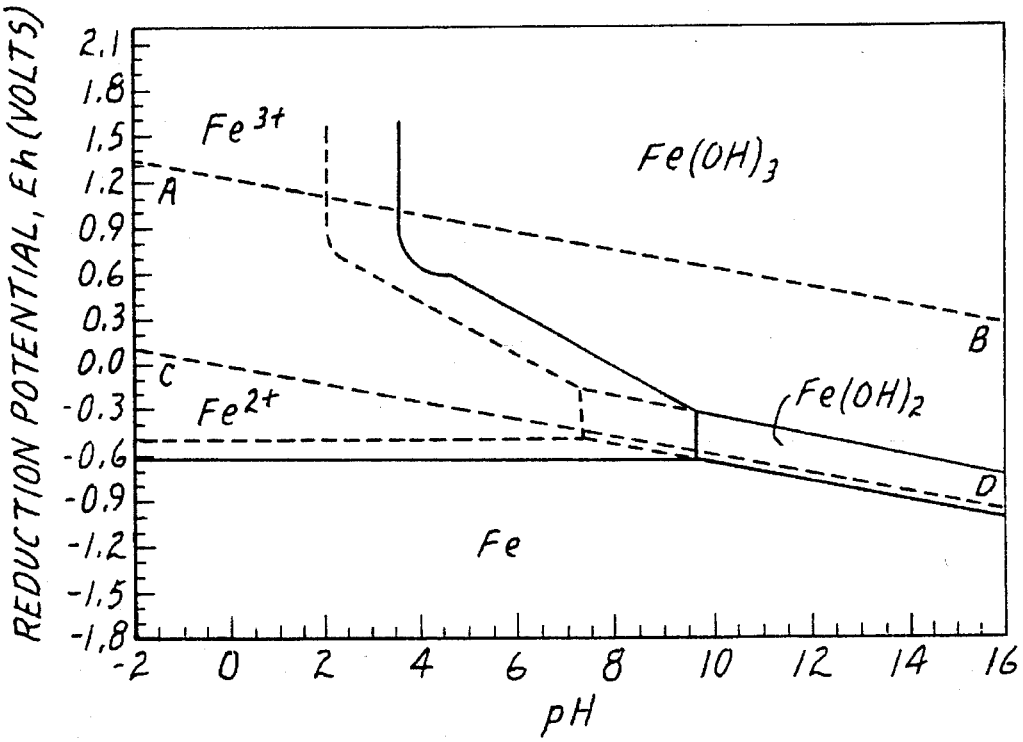
FIG. 1 is an Eh-pH diagram for a hydrated iron system.

The abscissa of FIG. 1 gives the pH and the ordinate Eh, i.e., the reduction potential with respect to the standard hydrogen electrode. The boundaries shown by the heavy solid lines between the soluble species (i.e. $Fe^{2+}$, $Fe^{3+}$) and the hydroxides are for a fixed total iron concentration of $\mathbf{10^{-6}}$ molal (an essentially iron-free solution). The separation between the regions $Fe^{3+}$and $Fe^{2+}$depends upon the ratio of their concentrations.

At unit activity of each species, a horizontal line (not shown) would intersect the boundary between the vertical and diagonal line at a potential of 0.771 volts. The labeled dashed lines A–B and C–D are, respectively, the theoretical limits for the stability of water, with the upper line (A–B) being the dissociation of water to oxygen, and the lower line (C–D), being the dissociation of water to hydrogen. The unlabeled-dashed lines are for iron concentrations in one leach liquor which has a total iron concentration of 2.38 g/l (0.0426 molal).

FIG. 1 maps out the various conditions of potential and pH for which iron will precipitate under equilibrium conditions. As expected, higher iron concentration permit higher hydrogen ion concentrations (lower pH values) to effect precipitation.

Figure 2:
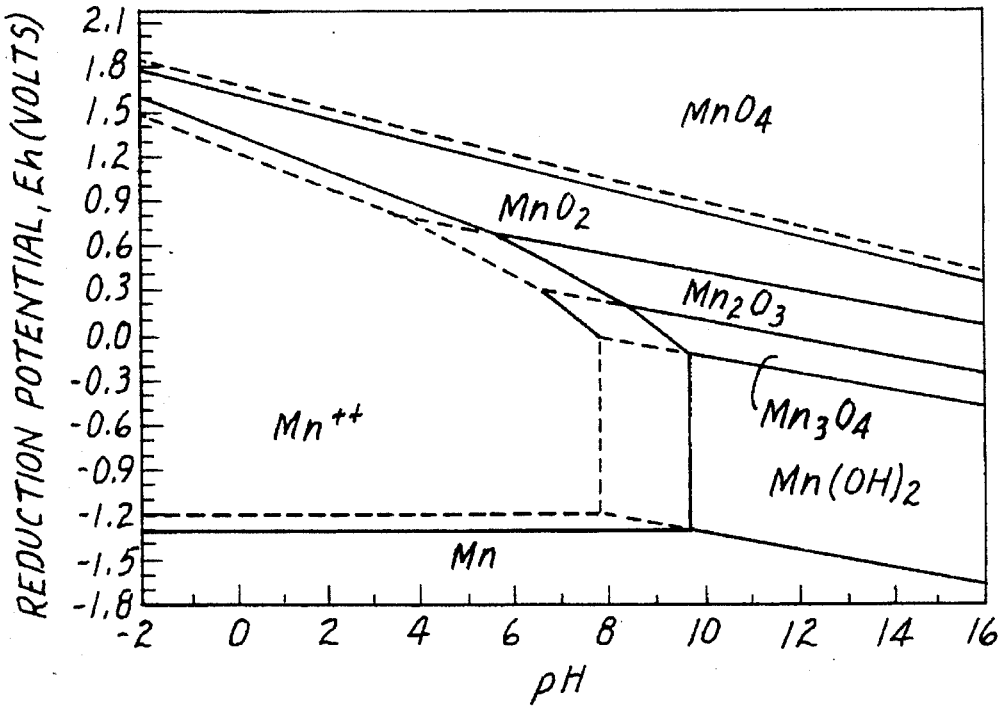
FIG. 2 is an Eh-pH diagram for a hydrated manganese system.

FIG. 2 is a plot constructed in a similar manner for manganese. The boundaries indicated by the solid lines are, however, for the soluble species ($Mn^{2+}$) and the oxides and hydroxide at a concentration of manganese of $\mathbf{10}^{-4}$ molal, which would represent a high manganese recovery. The dashed lines are drawn for an initial solution concentration of manganese of 28.08 g/l (0.511 molal).

Examination of FIGS. 1 and 2 separately provides for no definite conclusions regarding selective precipitation between $Mn^{2+}$and $Fe^{2+}$as these species tend to be stable under similar conditions of Eh and pH.

Figure 3:
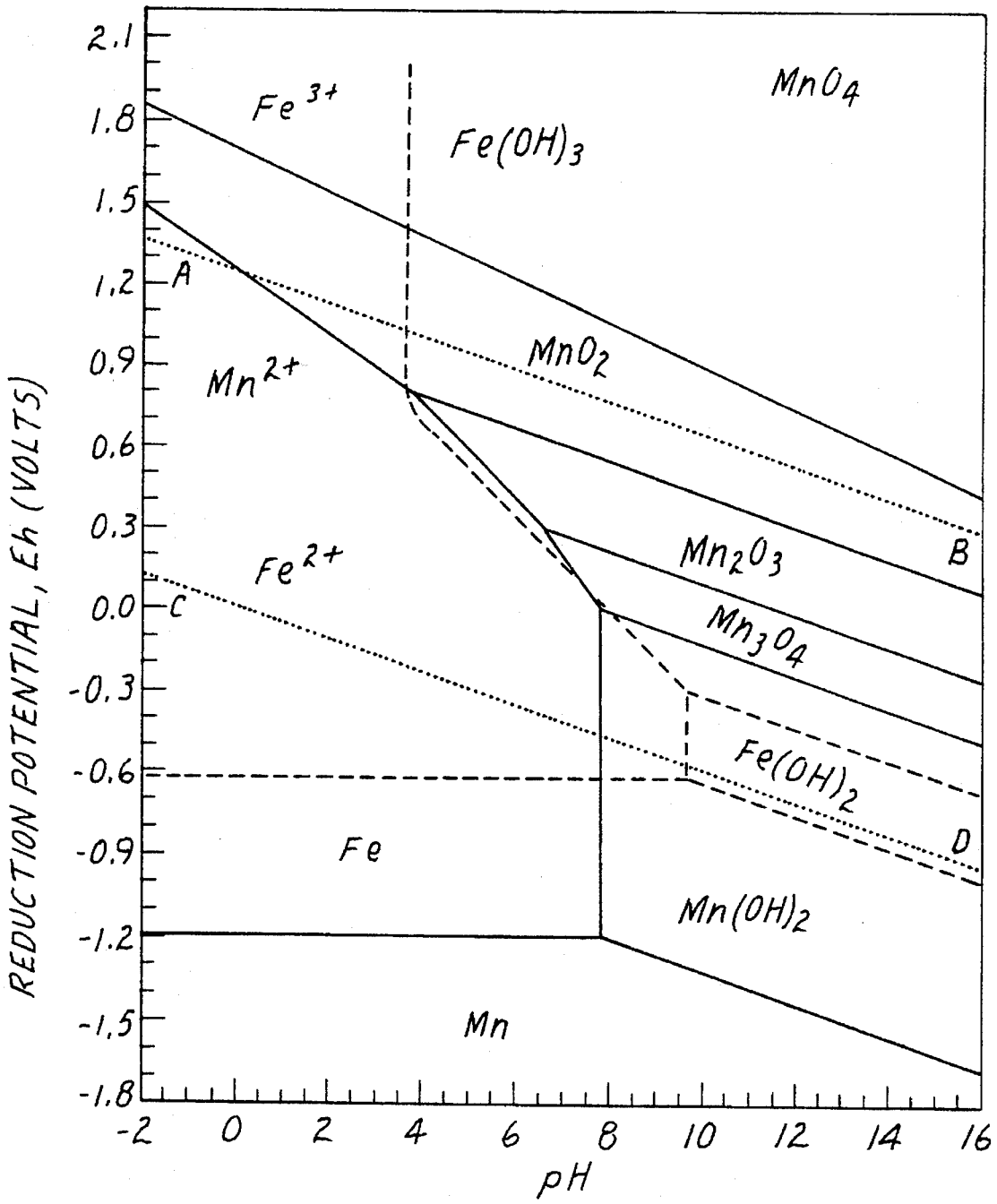
FIG. 3 is a superimposed Eh-pH diagram combining both the hydrated iron and hydrated manganese systems depicted in FIGS. 1 and 2.

FIG. 3 is a superimposition of FIGS. 1 and 2 for the conditions: iron at $\mathbf{10}^{-6}$ molal (heavy dashed lines) and manganese at 0.511 molal (solid lines). These two concentrations are preferred for precipitation of iron from the starting leach liquor. As with FIG. 1, lines (A) and (CD) represent the theoretical stability of water.

FIG. 3 shows that under equilibrium conditions, i.e., a line running substantially from point E to point F on FIG. 3, separation of iron from manganese by selective precipitation is confined to the narrow lenticular region the left-center of the diagram Furthermore, this region becomes more and more limited with increasing manganese concentration in the starting leach liquor solution. Separation under these equilibrium conditions is essentially unobtainable.

It is at this point that the present invention provides its advantages. By capitalizing on the kinetic factors, methods according to the present invention are capable of selectively precipitating substantially all of the iron while maintaining substantially all of the manganese in solution.

For the narrow lenticular region extending generally from point E to point F in FIG. 3, iron precipitates via the oxidation reaction:

$$Fe^{2+}+3OH-\rightarrow Fe(OH)_3+e- \quad (1)$$

Because this is an oxidation/reduction reaction, there is the implication that by addition of a suitable oxidizing agent, the lower solubility product of ferric hydroxide can be advantageously used, provided iron oxidizes in preference to manganese.

At extremely high oxidizing potentials (>1.9 volt) FIG. 3 shows that iron exists in the ferric state and its precipitation as ferric hydroxide is feasible at pH values as low as 4. Manganese will still be soluble in the $MnO_4^-$-form Conditions also exist where manganese will precipitate before the iron as $MnO_2$. However, co-precipitation of iron or its adsorption with the manganese would be a distinct probability, causing contamination of the manganese; therefore, these highly oxidizing conditions should be avoided.

On the reducing side, FIG. 3 shows that reduction of ferrous iron to metallic iron by electrochemical reduction or hydrogen cementation is feasible while maintaining manganese in solution. Equilibrium precipitation of manganese is then possible at pH values of approximately 8 or higher. From a practical consideration, iron cementation at very low concentrations may not be quantitative.

Based on the above discussion, thermodynamic considerations alone are not sufficient for the practical realization of selective Mn/Fe separations. Accordingly, the present invention relies on kinetic factors which, as the results of this analysis indicate, play a major role in the selective precipitation of both iron and manganese. The minor elements, calcium, aluminum, silicon, magnesium, and potassium must also be followed with respect to their distribution between purified manganese solution and the iron precipitate.

Column leach experiments have been carried out by the U.S. Bureau of Mines, Twin Cities Research Center (TCRC), on Cuyuna manganese ore samples (Algoma-Zeno 12% Mn Crude Ore (#5)–1+½). Leach solutions were produced by contacting 3500 g of ore with 120 liters of 5% by weight sulfurous acid solutions at a rate of 1 ml per minute down flow at 25° C.

The leaching procedure typically produced a liquor of the composition given in Table 1, above. The objective of the present invention is to separate manganese in useful form from the other constituents in solution, with an emphasis on iron became it represented the largest factor in limiting the performance of desulfurization pellets manufactured with the manganese recovered in the form of manganese carbonate. Considerable success in obtaining a pure manganese carbonate product in accordance with methods of the present invention has been achieved by the Salt Lake Research Center (SLRC) of the U.S. Bureau of Mines.

Figure 4:
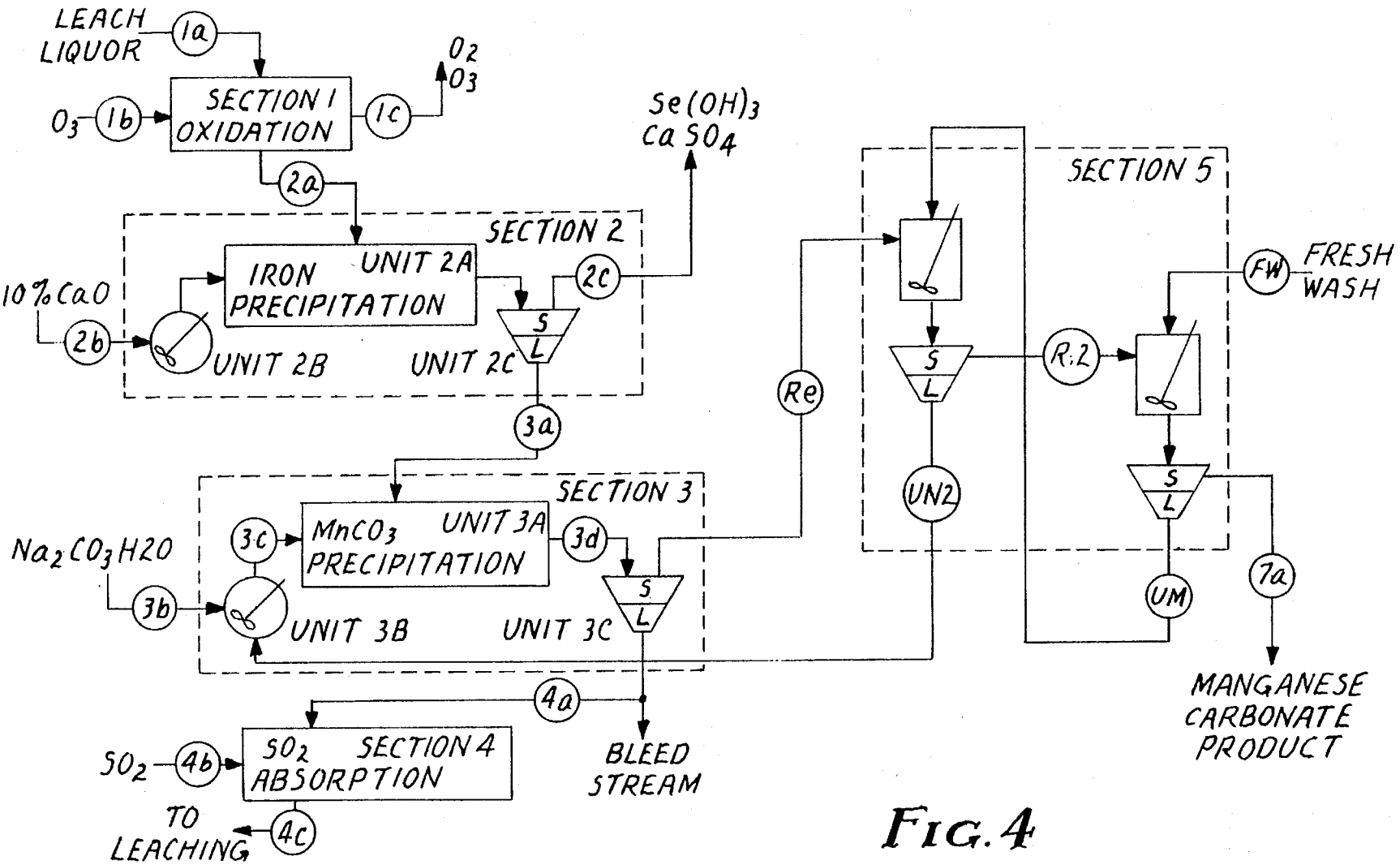
FIG. 4 is a schematic diagram of one method according to the present invention.

One preferred method according to the present invention is shown schematically in FIG. 4 and is comprised of the following five continuous unit operations: leach liquor oxidation, selective iron precipitation, selective manganese carbonate precipitation, sulfur dioxide adsorption, and product washing. A brief description of each of the unit operations follows:

1. Leach Liquor Oxidation

Leach liquor oxidation is carded out at room temperature, i.e., about 20 degrees C, in a stirred reactor with ozone. It will, however, be understood that a number of other oxidants, such as hydrogen peroxide and manganese dioxide could be effectively used in place of the preferred ozone which, in some cases may be more expensive than optimally desired considering economic factors. In any event it is preferred that the oxidizing agent not introduce additional elements not already present in the process solutions, particularly those which negatively affect the quality of the manganese carbonate for use as sorbent pellets. All of the oxidants named above add only oxygen, hydrogen or manganese, thereby satisfying that requirement.

The oxidation potential of the liquor was controlled in the range of 700–800 mV, measured with a platinum-silver/silver chloride electrode preferably immersed in the liquid such that its sensing tip is very close to the point at which the feed is introduced to ensure reliable potential measurement and control. At these conditions, all ferrous iron, $Fe^{2+}$, is oxidized to the ferric state, $Fe^{3+}$, and residual sulfur dioxide, $SO_2$, is oxidized to the sulfate ion, $SO_4^{2-}$, according to reactions 2 and 3.

$$2Fe^{2+}+2H^{+}+O_3\rightarrow 2Fe^{3+}+O_2+H_2O \quad (2)$$

$$SO_2+H_2O+2O_3\rightarrow SO_4^{2-}+2H^{+}+(5/2)O_2 \quad (3)$$

The oxidizing liquor overflows the reactor and reports by gravity flow to the iron precipitation reactor.

2. Selective Iron Precipitation

A. Using Milk of Lime

The oxidizing leach liquor is treated at room temperature in a second stirred reactor to precipitate ferric hydroxide. Milk of lime (10% slurry) is added to raise and maintain the solution pH to about 3.90 to 4.10, preferably 4.0. Consequently, gypsum, $CaSO_4$, co-precipitates with the ferric hydroxide according to reaction 4.

$$Fe_2(SO_4)_3+3Ca(OH)_2 \rightarrow 2Fe(OH)_3+3CaSO_4 \quad (4)$$

A ferric hydroxide/gypsum slurry overflows the iron precipitation reactor and is filtered. Co-precipitation of the gypsum is fortuitous as it greatly improves the filterability of the precipitate and removes calcium and some sulfate from the process stream The filtrate is essentially iron-free, assaying less than 0.03 ppm iron. Total manganese losses to the iron precipitate using this method are typically about 3%.

Iron precipitation is essentially fully completed at about one hour after addition of the milk of lime. For the purposes of the present invention, i.e., removal of sufficient iron to allow processing of the manganese carbonate precipitate into sorbent pellets for desulfurization of coal-derived fuel gases, precipitation of iron reaches acceptable levels with a minimum retention time of about 30 minutes. In any event, it will be understood that iron precipitation should reduce the iron concentration to about 15 ppm or less.

B. Using Manganese Dioxide

An alternative approach to iron removal by oxidizing the leach solution with ozone followed by adding milk of lime to precipitate $Fe(OH)_3$ is to air oxidize a small quantity of the manganese carbonate product eventually produced as described below to manganese dioxide. The manganese dioxide can then be used as an oxidant for the iron in place of the ozone. Alternatively, pure $MnO_2$ can be obtained from any source, including manganese ore.

In one process using manganese dioxide as the oxidizing agent, the leach liquor is preferably air sparged to remove all of the dissolved $SO_2$ before adding manganese dioxide.

In another process using manganese dioxide as the oxidizing agent, the leach liquor, which was saturated with $SO_2$, was contacted with manganese dioxide before air sparging. Consumption of manganese dioxide was greater in this process, as compared to the process in which the air sparging was conducted before adding the manganese dioxide.

In either process using $MnO_2$ as the oxidizing agent, air sparging was conducted for one hour or until the solution Eh reached 672 Mv (as compared to hydrogen). The solution pH was initially adjusted to a value of 1.0 with sulfuric acid to assist in driving off the sulfur dioxide. The overall reaction for the oxidation of iron is given in the equation below:

$$MnO_2+2Fe^{2+}+4H_2O \rightarrow Mn^{2+}+2H^{+}+2Fe(OH)_3 \quad (5)$$

Precipitation of iron was conducted at 25° C. (after aeration to drive off the sulfur dioxide) by stirring stoichiometric amounts of manganese dioxide (based upon the iron content) into 250 ml of solution.

A typical test duration was one hour during which the pH was adjusted with sodium hydroxide to a value of pH of 1.6 in order to precipitate iron. The final iron content dropped from an initial value of 2.4 g/L to less than 15 ppm with most of the drop occurring within the first 15 to 20 minutes. The added manganese reported to the filtrate increased the assay from an initial value of 28 g/l to <30 g/L due to the use of $MnO_2$ as an oxidizing agent.

Although the level of iron contained in the systems in which manganese dioxide was used as the iron oxidizing and precipitating agent was significantly higher than the 0.03 ppm achieved when using ozone as the oxidizing agent, the resulting 15 ppm of iron in the filtrate is sufficient to produce manganese carbonate suitable for manufacturing sorbent pellets for desulfurizing coal-derived fuel gases.

When using manganese dioxide as an oxidizing agent according to the present invention, the iron precipitation step is preferably terminated at less than about two hours, preferably less than about one hour and most preferably less than about 20 minutes. At those intervals, in which the system has not reached equilibrium, substantially all of the iron precipitates out of the solution while substantially all of the manganese remains in solution. As a result, further processing can be performed to remove the remaining manganese in usable form as manganese carbonate.

3. Selective Manganese Carbonate Precipitation

The substantially iron-free liquor is pumped at room temperature into a third stirred reactor to precipitate manganese carbonate according to reactions 6 and 7.

$$MnSO_4+Na_2CO_3 \rightarrow MnCO_3+Na_2SO_4 \quad (6)$$

$$MnS_2O_6+Na_2CO_3 \rightarrow MnCO_3+Na_2S_2O_6 \quad (7)$$

Figure 5:
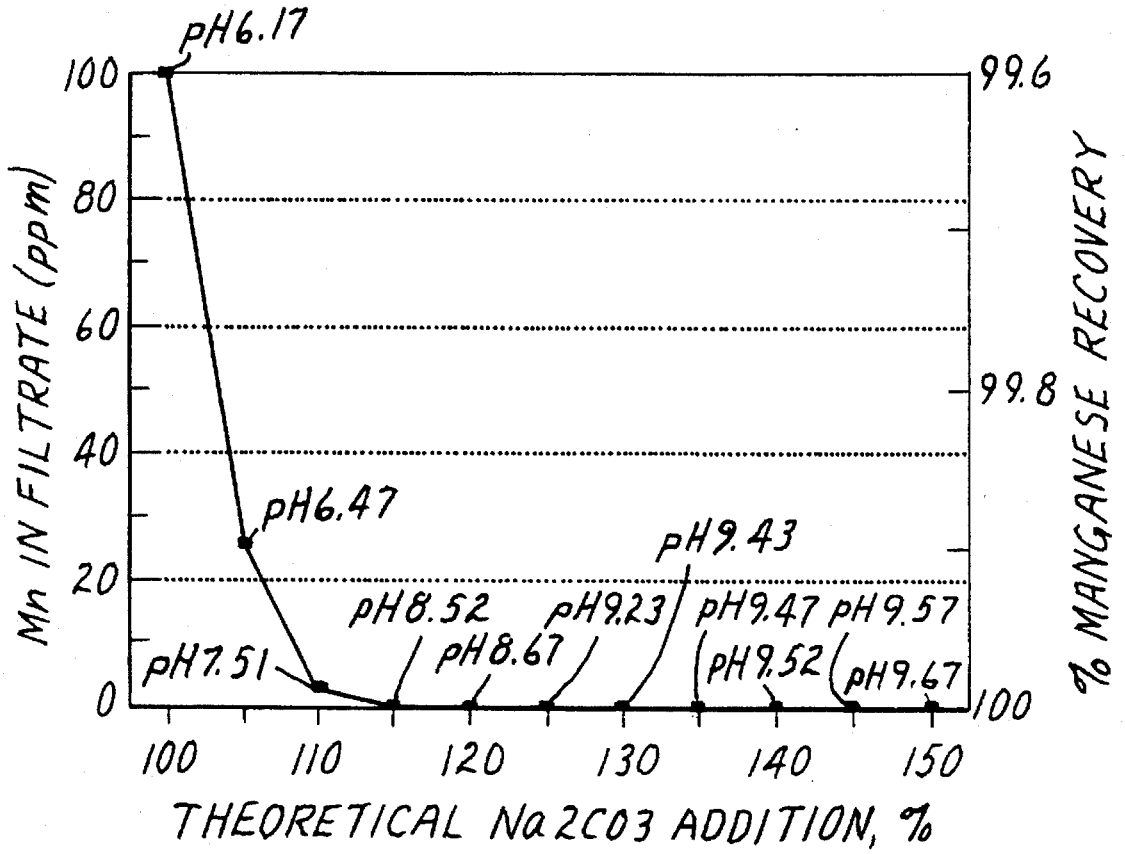
FIG. 5 is a diagram depicting the effect of sodium carbonate addition to manganese recovery after precipitation of iron from the leach liquor.

The sodium carbonate is metered to the reactor as a nearly saturated solution (300 g/L) such that the solution pH is controlled at about 8.0 or above. At an average retention time of one hour, over 99% of the available manganese precipitates. The relationships between liquor pH, sodium carbonate addition, and manganese recovery are given in FIG. 5.

4. Sulfur Dioxide Adsorption

The manganese carbonate slurry overflows the reactor and is filtered. The filtrate stream is split such that about 30% of the stream is bled off to waste and 70% reports to sulfur dioxide adsorption. Here, the lixiviant is regenerated to a 2–7% sulfur dioxide solution using a standard packed adsorption column. The regenerated lixiviant can then be recycled to leaching.

5. Product Washing:

The manganese carbonate filter-cake is repetitively water washed to remove entrained sodium sulfate, dithionate, and soluble carbonate. The composition of one sample of the dried manganese carbonate product produced using one method according to the present invention is given in Table 3. It is preferred that the dry filter cake comprises about 98% (wt) manganese carbonate to provide suitable feed material for the production of electrolytic manganese metal, electrolytic manganese dioxide, and, most importantly, manganese-based sorbent pellets for the desulfurization of coal-derived fuel gases. The concentration of iron in the filter cake is typically at or below measurable limits. As indicated in Table 3, iron was not measured in the sample filter cake.

TABLE 3

Product Filter Cake
(Assays in Percent unless otherwise noted)

| Species | Conc. | Species | Conc. | Species | Conc. |
|---|---|---|---|---|---|
| Mn | 40 | V | <0.01 | Na | 0.2 |
| $CO_3^{=}$ | 47 | Sr | 0.016 | K | 0.2 |
| As | 0.0002 | Co | 0.0004 | Ca | 0.16 |
| Sb | <0.002 | Ni | <0.001 | Mo | <0.01 |
| Cr | <0.0006 | Pb | <10.0034 | Hg | <0.13 ppm |

It should be noted that the SLRC laboratory investigation was initially comprised of single pass tests utilizing TCRC produced leach liquors and continuous processing equipment. Process solutions were not recycled in this investigation. Based on test results, an iterative process simulation was used to predict steady-state leach liquor composition when process solutions are repeatedly recycled to the leaching process.

Initial steady-state material balances predicted very high sodium, sulfate, and dithionate concentrations in the leach liquors and process solutions, see first prediction leach liquor composition in Table 4. These high concentrations caused considerable concern for saturated solutions and precipitation.

TABLE 4

| | Actual and predicted manganese leach liquor compositions, g/L | | | |
|---|---|---|---|---|
| | | | SLRC | |
| Con- | TCRC | | simulated | 2nd |
| stituent | as produced | 1st prediction | steady-state | prediction |
| Al | 0.38 | 0.35 | 0.72 | 0.39 |
| Ca | 0.35 | 0.31 | 0.56 | 0.36 |
| Fe | 2.1 | 1.75 | 4.8 | 2.1 |
| K | 0.67 | 1.3 | 1.8 | 1.4 |
| Mg | 0.09 | 0.21 | 0.20 | 0.16 |
| Mn | 28 | 28 | 35 | 30 |
| Na | 0.1 | 50 | 25.2 | 27 |
| $S_2O_6$ | 55 | 100 | 110 | 140 |
| $SO_4$ | 28 | 46 | 75.2 | 34 |

In light of these concerns, the processing scheme was tested with a leach liquor of the steady-state composition depicted in Table 4. Simulated steady-state leach liquors were then used in a second laboratory-scale test campaign. Results were evaluated using an iterative process simulation which provided a second prediction of steady-state leach liquor composition depicted in Table 4. Comparison of data indicates that the second steady-state leach liquor composition predicted by the simulation was close to that of the steady-state leach liquor used in laboratory testing. No processing problems were encountered with the simulated steady-state leach liquors in methods according to the present invention.

We claim:

1. A method of producing manganese carbonate from a leach liquor, the method comprising the steps of:

a) providing a sulfurous acid leach solution comprising manganese and iron;

b) oxidizing the iron in the solution by combining an oxidizing agent with the solution while maintaining the oxidation potential of the solution between about 650 to about 800 mV measured with a platinum-silver/silver chloride electrode, wherein the oxidizing agent is selected from the group consisting of ozone and hydrogen peroxide;

c) selectively precipitating substantially all of the iron out of the solution as ferric hydroxide in a kinetic reaction lasting less than about two hours while maintaining substantially all of the manganese in solution, wherein the step of precipitating substantially all of the iron comprises adding milk of lime to the solution after the step of oxidizing, and further wherein gypsum co-precipitates with the ferric hydroxide;

d) filtering substantially all of the ferric hydroxide and gypsum out of the solution; and e) selectively precipitating manganese out of the solution as manganese carbonate by adding sodium carbonate.

2. A method according to claim 1, wherein the solution pH is raised and maintained at about 3.9 to about 4.1 by the combination of milk of lime with the solution.

3. A method according to claim 1, wherein the step of precipitating iron comprises precipitating iron to leave the solution with less than about 15 ppm of iron.

4. A method according to claim 1, wherein the step of precipitating iron comprises precipitating iron to leave the solution with less than about 5 ppm of iron.

5. A method according to claim 1, wherein the step of precipitating iron comprises precipitating iron to leave the solution with less than about 1 ppm of iron.

6. A method according to claim 1, wherein the step of precipitating manganese comprises raising and maintaining the solution pH to about 8.0 or above.

7. A method according to claim 1, wherein the step of precipitating manganese provides a dry filter cake comprising at least about 98% wt manganese carbonate.

8. A method according to claim 1, wherein the step of providing the leach solution comprises in sire leaching of manganese bearing ore formations.

9. A method according to claim 1, wherein the step of providing the leach solution comprises leaching of mined manganese bearing ore.

10. A method of producing manganese carbonate from a leach liquor, the method comprising the steps of:

a) providing a sulfurous acid leach solution comprising manganese and iron;

b) oxidizing the ferrous iron in the solution to ferric iron by combining ozone with the solution while maintaining the oxidation potential of the solution between about 650 to about 800 mV measured with a platinum-silver/silver chloride electrode;

c) selectively precipitating substantially all of the iron out of the solution as ferric hydroxide by combining milk of lime with the solution after the oxidizing step, wherein the solution pH is raised and maintained at about 3.9 to about 4.1 by the combination of milk of lime with the solution, and wherein the iron precipitating step leaves the solution with less than about 15 ppm of iron, and wherein the iron precipitating step lasts less than about one hour while maintaining substantially all of the manganese in solution; and d) selectively precipitating manganese out of the solution as manganese carbonate by the addition of sodium carbonate to raise and maintain the solution pH to about 8.0 or above; wherein the manganese precipitate provides a dry filter cake comprising at least about 98% wt manganese carbonate.

11. A method according to claim 10, wherein the step of providing the leach solution comprises in sire leaching of manganese bearing ore formations.

12. A method of producing manganese carbonate from a leach liquor, the method comprising the steps of:

a) providing a sulfurous acid leach solution comprising manganese and iron;

b) air sparging the solution to remove sulfur dioxide;

c) oxidizing the iron in the solution by combining manganese dioxide with the solution while maintaining the oxidation potential of the solution between about 650 to about 800 mV measured with a platinum-silver/silver chloride electrode;

c) selectively precipitating substantially all of the iron out of the solution as ferric hydroxide by combining an additional amount of manganese dioxide with the solution, wherein the iron precipitating step leaves the solution with less than about 15 ppm of iron, and wherein the iron precipitating step lasts less than about one hour while maintaining substantially all of the manganese in solution; and d) selectively precipitating manganese out of the solution as manganese carbonate by the addition of sodium carbonate to raise and maintain the solution pH to about 8.0 or above; wherein the manganese precipitate provides a dry filter cake comprising at least about 98% wt manganese carbonate.

13. A method of producing manganese carbonate from a leach liquor, the method comprising the steps of:

a) providing a sulfurous acid leach solution comprising manganese and iron;

b) air sparging the solution to remove dissolved sulfur dioxide from the solution;

c) oxidizing the iron in the solution by combining manganese dioxide with the solution while maintaining the oxidation potential of the solution between about 650 to about 800 mV measured with a platinum-silver/silver chloride electrode;

d) selectively precipitating iron out of the solution as ferric hydroxide in a kinetic reaction lasting about two hours or less while maintaining substantially all of the manganese in solution, wherein the step of precipitating substantially all of the iron comprises adding manganese dioxide to the solution after the step of oxidizing; and e) selectively precipitating manganese out of the solution as manganese carbonate by the addition of sodium carbonate.

14. A method according to claim 13, wherein the solution pH is adjusted to about 1.6 to begin iron precipitation.

15. A method according to claim 14, wherein the step of adjusting pH comprises combining sodium hydroxide with the solution.

* * * * *